US009136963B2

(12) United States Patent
Yen et al.

(10) Patent No.: US 9,136,963 B2
(45) Date of Patent: Sep. 15, 2015

(54) WIRELESS TRANSMISSION APPARATUS AND RELATED WIRELESS TRANSMISSION METHOD

(75) Inventors: Kuang-Yu Yen, Tai-Chung (TW); Jiun-Hung Yu, Nan-Tou Hsien (TW); Der-Zheng Liu, Hsinchu County (TW); Chung-Yao Chang, Tai-Chung (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 1975 days.

(21) Appl. No.: 12/017,351

(22) Filed: Jan. 22, 2008

(65) Prior Publication Data

US 2008/0176509 A1 Jul. 24, 2008

(30) Foreign Application Priority Data

Jan. 24, 2007 (TW) ..... 096102676

(51) Int. Cl.

| | |
|---|---|
| ***H04H 20/71*** | (2008.01) |
| ***H04H 60/11*** | (2008.01) |
| ***H04H 20/42*** | (2008.01) |
| ***H04H 20/61*** | (2008.01) |

(52) U.S. Cl.

CPC ..... *H04H 60/11* (2013.01); *H04H 20/42* (2013.01); *H04H 20/61* (2013.01)

(58) Field of Classification Search

CPC ..... H04L 1/08; H04L 1/20; H04L 1/0003; H04L 12/40156

USPC ..... 455/3.01; 370/445, 462

See application file for complete search history.

(56) References Cited

U.S. PATENT DOCUMENTS

| | | | | |
|---|---|---|---|---|
| 6,877,043 | B2 * | 4/2005 | Mallory et al. | 709/251 |
| 6,882,634 | B2 * | 4/2005 | Bagchi et al. | 370/338 |
| 6,888,844 | B2 * | 5/2005 | Mallory et al. | 370/466 |
| 6,891,881 | B2 * | 5/2005 | Trachewsky et al. | 375/143 |
| 6,898,204 | B2 * | 5/2005 | Trachewsky et al. | 370/445 |
| 6,925,094 | B2 | 8/2005 | Sharony et al. | |
| 6,954,800 | B2 * | 10/2005 | Mallory | 709/240 |
| 6,975,655 | B2 * | 12/2005 | Fischer et al. | 370/516 |
| 6,988,236 | B2 * | 1/2006 | Ptasinski et al. | 714/758 |
| 6,993,101 | B2 * | 1/2006 | Trachewsky et al. | 375/343 |

(Continued)

FOREIGN PATENT DOCUMENTS

| | | |
|---|---|---|
| TW | 200405700 | 4/2004 |
| TW | 200410515 | 6/2004 |
| TW | 200612761 | 4/2006 |

*Primary Examiner* — Wesley Kim
*Assistant Examiner* — Richard Chan
(74) *Attorney, Agent, or Firm* — McClure, Qualey & Rodack, LLP

(57) ABSTRACT

A wireless transmission method for broadcasting packets to a plurality of receiving devices includes: broadcasting a plurality of packets to the receiving devices, receiving signals transmitted from the receiving devices, generating a plurality of estimation results according to the signals transmitted from the receiving devices where each of the estimation results corresponds to a receiving quality while each of the receiving devices receives the packets, determining whether each of the receiving devices is suitable for receiving the packets according to each of the estimation results and a recipient condition and storing information of at least one of the receiving devices suitable for receiving the packets, and determining whether the at least one of the receiving devices needs to receive a broadcasted packet again according to the information and signals transmitted from the at least one of the receiving devices suitable for receiving the packets.

36 Claims, 3 Drawing Sheets

(56) References Cited

U.S. PATENT DOCUMENTS

| | | | | |
|---|---|---|---|---|
| 7,000,031 | B2 * | 2/2006 | Fischer et al. | 709/248 |
| 7,035,285 | B2 * | 4/2006 | Holloway et al. | 370/474 |
| 7,388,853 | B2 * | 6/2008 | Ptasinski et al. | 370/338 |
| 7,406,106 | B2 * | 7/2008 | Mallory | 370/522 |
| 7,822,005 | B2 * | 10/2010 | Ptasinski et al. | 370/338 |
| 8,730,832 | B2 * | 5/2014 | Chang et al. | 370/252 |
| 2001/0055311 | A1 * | 12/2001 | Trachewsky et al. | 370/445 |
| 2002/0006136 | A1 * | 1/2002 | Mallory et al. | 370/466 |
| 2002/0012343 | A1 * | 1/2002 | Holloway et al. | 370/389 |
| 2002/0026523 | A1 * | 2/2002 | Mallory et al. | 709/236 |
| 2002/0027886 | A1 * | 3/2002 | Fischer et al. | 370/255 |
| 2002/0041570 | A1 * | 4/2002 | Ptasinski et al. | 370/252 |
| 2002/0042836 | A1 * | 4/2002 | Mallory | 709/232 |
| 2002/0057713 | A1 * | 5/2002 | Bagchi et al. | 370/468 |
| 2002/0057717 | A1 * | 5/2002 | Mallory | 370/503 |
| 2002/0080886 | A1 * | 6/2002 | Ptasinski et al. | 375/295 |
| 2002/0131441 | A1 * | 9/2002 | Trachewsky et al. | 370/441 |
| 2002/0163932 | A1 * | 11/2002 | Fischer et al. | 370/465 |
| 2003/0206559 | A1 * | 11/2003 | Trachewsky et al. | 370/509 |
| 2004/0081115 | A1 * | 4/2004 | Parsa et al. | 370/320 |
| 2004/0081127 | A1 * | 4/2004 | Gardner et al. | 370/338 |
| 2005/0025254 | A1 | 2/2005 | Awad | |
| 2005/0259663 | A1 * | 11/2005 | Ode et al. | 370/395.4 |
| 2006/0174288 | A1 | 8/2006 | Bichot et al. | |
| 2006/0287743 | A1 | 12/2006 | Sampath | |
| 2009/0285109 | A1 * | 11/2009 | Chin et al. | 370/252 |

* cited by examiner

WIRELESS TRANSMISSION APPARATUS AND RELATED WIRELESS TRANSMISSION METHOD

BACKGROUND OF THE INVENTION

1. Field of the Invention

The present invention relates to a wireless transmission apparatus and related method, and more particularly, to a wireless transmission apparatus and related method for broadcasting data.

2. Description of the Prior Art

Generally speaking, point-to-point data transmission in a wireless local area network involves a wireless local area network access point (WLAN AP) transmitting packets to a receiving device. If the receiving device correctly receives a packet, the receiving device responds with an ACK signal to the wireless local area network access point. For this reason, if the wireless local area network access point does not receive the ACK signal within a predetermined period, this represents that the packet was not correctly received by the receiving device. Hence, the wireless local area network access point will retransmit the packet until the packet is correctly received or until the wireless local area network access point has abandoned the packet after retransmitting the packet a predetermined number of times. However, this kind of point-to-point data transmission is not suitable for broadcasting data, because the wireless local area network access point needs to consider whether each receiving device has responded to the ACK signal corresponding to the packet to select whether to retransmit the packet or to transmit a next packet. Thus, the wireless local area network access point must inquire with each receiving device whether the receiving device has received the packet correctly or not through a designating network address of each receiving device every time a transmission operation is completed. This significantly reduces available bandwidth of the wireless network. A data broadcast mechanism is disclosed in the prior art wherein the wireless local area network access point directly broadcasts the packet without considering whether the previous packet was correctly received when the wireless local area network access point operates in a broadcast mode. Although this kind of data broadcast method may not have problems when broadcasting general data, some receiving devices having poor receiving quality will possibly have a poor AV quality (for example, packet loss may cause video frames to suspend) when utilizing this kind of broadcast method to broadcast AV programs.

In addition, the bandwidth of wireless networks has recently reached to at least 20 Mbps; therefore, it is not a problem to broadcast one program to several receiving devices because only 6 Mbps bandwidth is occupied. However, when transmitting several AV programs, such as broadcasting a packet having three AV programs, the overall transmission bandwidth is limited by the receiving device not being able to correctly receive the packet due to not all the receiving devices being able to correctly receive the packet (for example, some receiving devices may not correctly receive the packet and need the wireless local area network access point to retransmit the packet frequently), which will result in other receiving devices being unable to successfully play received AV programs.

SUMMARY OF THE INVENTION

It is therefore one of the objectives of the present invention to provide a wireless transmission apparatus and related method for broadcasting several AV programs to a plurality of receiving devices in WLAN while simultaneously maintaining perfect AV quality to solve the abovementioned problem. Additionally, the present invention further provides a data broadcasting method for transmitting/receiving broadcasted data through encoding/decoding operations and interleaving/de-interleaving operations in WLAN to be able to correct errors to solve the problem of over-high packet error rate (PER) in network environment.

According to one embodiment of the present invention, a wireless transmission apparatus for broadcasting packets to a plurality of receiving devices is disclosed. The wireless transmission apparatus includes a transmitter, a receiver, and an estimation circuit. The transmitter is used for broadcasting packets to the receiving devices. The receiver is used for receiving signals transmitted from any one of the receiving devices. The estimation circuit is coupled to the receiver for determining whether each of the receiving devices is suitable for receiving the packets broadcasted by the wireless transmission apparatus according to the signals transmitted from the receiving devices and a recipient condition. The estimation circuit includes a signal quality estimation circuit, a control circuit, and a storage unit. The signal quality estimation circuit is used for generating a plurality of estimation results according to the signals transmitted from the receiving devices, whereof each of the estimation results corresponds to a recipient quality of each receiving device while receiving the packets broadcasted by the wireless transmission apparatus. The control circuit is coupled to the signal quality estimation circuit for determining whether each of the receiving devices is the target receiving device or not according to each estimation result and the recipient condition. The storage unit is coupled to the control circuit for storing information of at least one of the target receiving devices. The wireless transmission apparatus determines whether at least one of the target receiving devices needs to retrieve a broadcasted packet again according to the information and the signals transmitted from the at least one of the target receiving devices and rebroadcasts the broadcasted packet again if needed.

According to one embodiment of the present invention, a wireless transmission method for broadcasting packets to a plurality of receiving devices is disclosed. The wireless transmission method includes broadcasting a plurality of packets to the receiving devices, receiving signals transmitted from the receiving devices to generate a plurality of estimation results, each of the estimation results corresponds to recipient quality of each receiving device while receiving the packets, determining whether each of the receiving devices is suitable for receiving the packets according to each of the estimation results and a recipient condition and determining each one of the receiving devices that is suitable for receiving the packets as a target receiving device, storing information of at least one of the target receiving devices, and determining whether at least one of the target receiving devices needs to retrieve a broadcasted packet again according to the information and the signals transmitted from the at least one of the target receiving devices and re-broadcasting the broadcasted packet again if needed.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
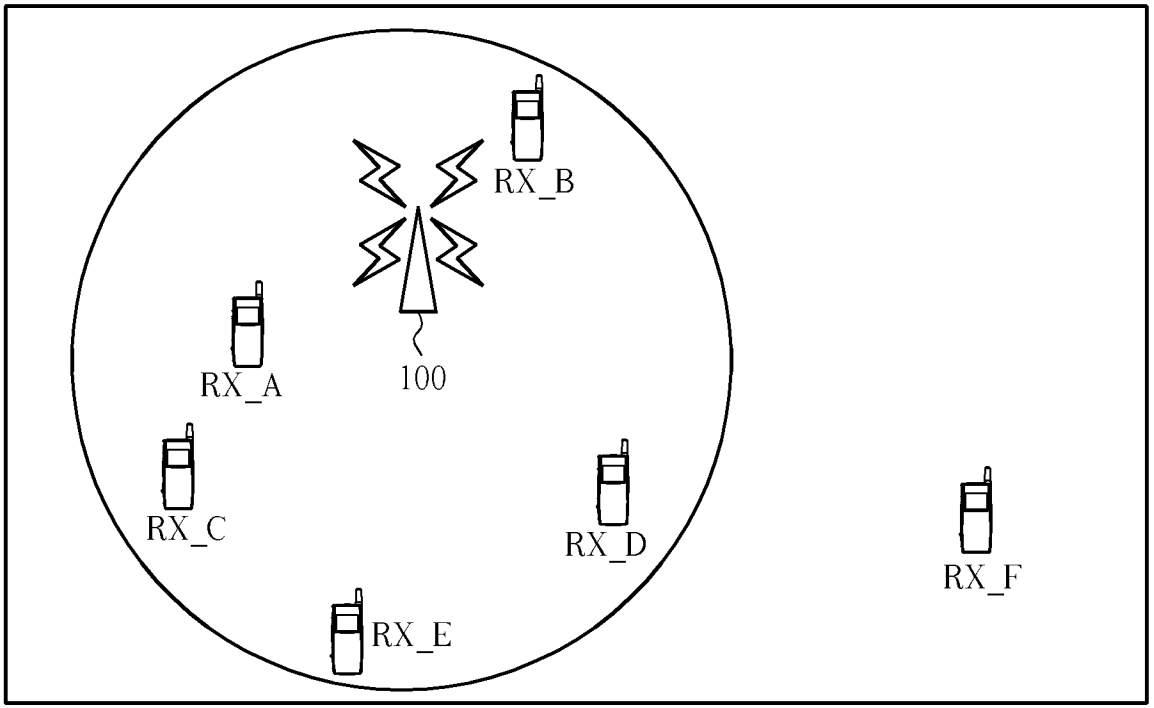
FIG. 1*a* is a diagram of a wireless broadcast system according to an embodiment of the present invention.

The present invention discloses a wireless transmission apparatus and related method for performing wireless broadcasting. FIG. 1*a* is a diagram of a wireless broadcast system according to an embodiment of the present invention. FIG. 1*a* shows the transmission relationship between a wireless transmission apparatus 100 and a plurality of receiving devices RX_A, RX_B, RX_C, RX_D, RX_E, and RX_F. As shown in FIG. 1*a*, transmission distances between the receiving devices RX_A, RX_B, RX_C, RX_D, RX_E, and RX_F and the wireless transmission apparatus 100 are not all the same, whereof the transmission distance between the receiving device RX_F and the wireless transmission apparatus 100 is the farthest. As a result, when the wireless transmission apparatus 100 broadcasts packets, such as broadcasting audio visual (AV) signals for TV programs, the receiving quality of the receiving device RX_F may be the worst. For this reason, the wireless transmission apparatus 100 may be required to often retransmit un-received packets, thus the transmission performance that could originally be achieved between the wireless transmission apparatus 100 and the receiving devices RX_A, RX_B, RX_C, RX_D, and RX_E will be lowered. Therefore, the wireless transmission apparatus 100 of the present invention excludes the receiving devices incompatible with a recipient condition according to the recipient condition (for example, ignore the request for retransmitting signals of the receiving device RX_F incompatible with the recipient condition), and selects a reference receiving device from the plurality of receiving devices compatible with the recipient condition as a basis of whether to rebroadcast packets (for example, to the receiving device RX_E, which has a second farthest distance from the wireless transmission apparatus 100). Please note that, in addition to the transmission distance, the design of the receiving device and other environment factors may affect the receiving quality of the receiving device. The wireless transmission apparatus determines how to perform data broadcasting by judging the receiving quality of the receiving device without directly considering various possible factors for affecting the receiving quality of the receiving device. Furthermore, one embodiment of the wireless transmission apparatus 100 of the present invention is a wireless local area network access point (WLAN AP), but this for example only and is not meant as a limitation of the present invention. As long as the wireless transmission apparatus or method are implemented based on the disclosure of the present invention, for example, a personal computer with wireless broadcasting function, a personal digital assistant (PDA), a mobile, or a TV set-top box, the result should fall within the scope of the present invention. Moreover, the present invention can be applied not only to WLAN transmission technology but also to wireless USB transmission technology and Bluetooth transmission technology.

As mentioned above, please keep referring to FIG. 1*a*. The wireless transmission apparatus 100 includes a transmitter, a receiver, and an estimation circuit (not shown in FIG. 1*a*). The transmitter and the receiver are circuits well-known to those skilled in the art and are respectively used for broadcasting packets to the receiving devices and for receiving signals transmitted from any one of the receiving devices. The estimation circuit can be configured with a signal-to-noise ratio (SNR) estimation circuit and/or a packet error rate (PER) estimation circuit, which are used for estimating the recipient quality of the receiving devices RX_A, RX_B, RX_C, RX_D, RX_E, and RX_F and then used for excluding the receiving devices incompatible with the recipient condition according to the recipient quality measured from each receiving device and the recipient condition (such as a threshold SNR value and/or a threshold PER value), and for selecting a reference receiving device from the plurality of receiving devices compatible with the recipient condition to make the wireless transmission apparatus 100 rebroadcast a packet when the reference receiving device requests the packet to be retransmitted.

As mentioned above, when the wireless broadcast system in FIG. 1*a* is initialized, the wireless transmission apparatus 100 can determine the throughput required for broadcasting according to the amount of broadcasting data, and then the packet format of wireless transmission and data rate of physical layer can be determined. Thus, either the abovementioned threshold SNR value and/or the threshold PER value can be the basis for stably receiving the broadcasting data, and this value is determined. Generally speaking, the higher the required throughput is, the fewer the receiving devices that satisfy the throughput. That is to say, fewer receiving devices can receive the broadcasting data stably. Hence, the wireless transmission apparatus 100 of the present invention can determine the required throughput for broadcasting according to a predetermined mechanism (such as detecting the data amount for broadcasting) or can display the amount of broadcasting data and the number of corresponding receiving devices that can stably receive the broadcasting data for users to choose through a user interface (such as the user interface the wireless transmission apparatus 100 provides or a personal computer coupled to the wireless transmission apparatus 100 provided with a out-connecting network). That is to say, the user can select more/less broadcasting data through the user interface to make more/less receiving devices stably receive the broadcasting data. In an embodiment of the present invention, the relationship between the abovementioned parameters such as the amount of broadcasting data, the throughput, the packet format, the data rate, the threshold SNR value, and the threshold PER value can be stored into a mapping table. The wireless transmission apparatus 100 utilizes the mapping table to determine other parameters according to the amount of broadcasting data. As the implementation of mapping tables is well-known to the one skilled in the art, further detailed description is omitted herein.

Figure 1B:
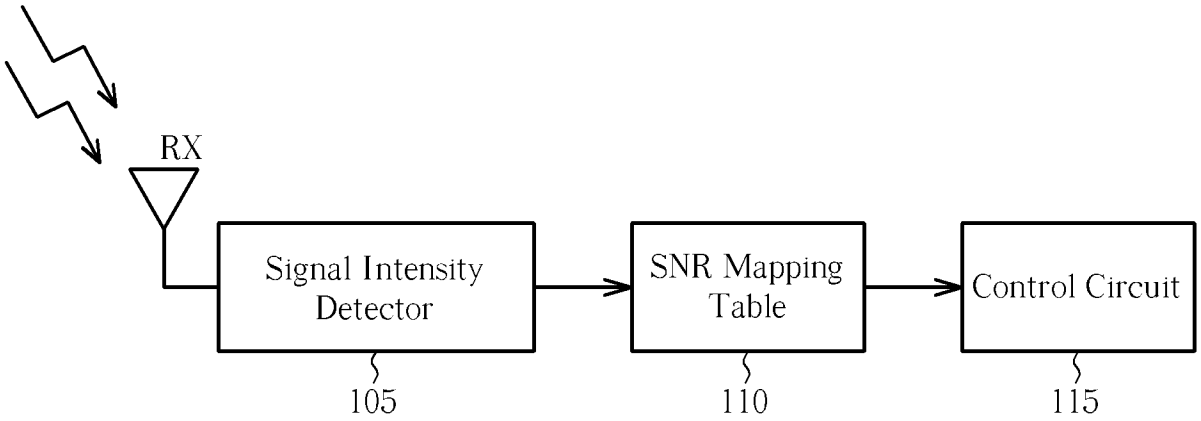
FIG. 1*b* is a diagram of an SNR estimation circuit according to an embodiment of the present invention.

One embodiment of the abovementioned SNR estimation circuit is shown in FIG. 1*b*, which includes a signal intensity detector 105, an SNR mapping table, 110, and a control circuit 115. When a particular receiving device desires to connect to the wireless transmission apparatus 100, a signal is transmitted to the wireless transmission apparatus 100. Meanwhile, the SNR estimation circuit of the wireless transmission apparatus 100 performs an SNR estimation according to the signal. The operation of the SNR estimation circuit is described as follows: the signal intensity detector 105 estimates the intensity of the signal; the SNR mapping table 110 generates a corresponding SNR value according to the intensity of the signal; the control circuit 115 excludes the receiving device incompatible with the recipient condition according to the SNR value and a SNR threshold value and selects at least one reference receiving device(s) from the receiving devices compatible with the SNR threshold value. In this embodiment, the control circuit 115 records all the receiving devices compatible with the SNR threshold value and the reference receiving device into a list table, whereof the list table is stored in a storage unit. Thus, the wireless transmission apparatus 100 can determine a broadcasting mechanism according to the list table. Please note that the SNR estimation circuit in FIG. 1*b* is not meant as a limitation of the present invention, and those skilled in the art can perform the SNR estimation by utilizing various prior methods. For example, the signal transmitted by the receiving device could be processed by a base-band circuit of the wireless transmission apparatus 100 to estimate the corresponding SNR value, and then the control circuit 115 could determine which receiving device is suitable for receiving broadcasting data according to the SNR value and the SNR threshold value.

The abovementioned PER estimation circuit is used for estimating the packet error ratio to which each receiving device corresponds, whereof one embodiment of the PER estimation circuit includes a control circuit for notifying the wireless transmission apparatus 100 to send training packets of a particular number and fixed modulated format to a particular receiving device. The format of the training packets can be binary phase-shift keying (BPSK), quadrature phase-shift keying (QPSK), 16 quadrature amplitude modulation (16 QAM), 64 quadrature amplitude modulation (64 QAM), 128 quadrature amplitude modulation (128 QAM), or 256 quadrature amplitude (256 QAM), which will be appreciated by one skilled in the art as different formats corresponding to different throughputs. When the particular receiving device correctly receives the training packet of one certain format, an acknowledge (ACK) signal is transmitted to notify the wireless transmission apparatus 100. A counter is used for counting the number of acknowledge signals generated when the particular receiving device receives the training packets of the particular format. The larger the number of the acknowledge signals, the lower the packet error ratio generated when the particular receiving device receives the training packets of the particular format. The control circuit obtains each packet error rate corresponding to each packet format received by the particular receiving device according to the count value of the counter, and then determines the maximum throughput that satisfies the particular receiving device. In this embodiment, the control circuit can reset the counter after the wireless transmission apparatus 100 accomplishes transmitting the training packets of one particular format, and notifies the wireless transmission apparatus 100 to transmit a training packet of another format. Through this manner, the counter can respectively count the number of ACK signals generated when the particular receiving device receives the training packets of different formats and the control circuit can determine the maximum throughput that satisfies the particular receiving device. In addition, after accomplishing the test of the particular receiving device, the PER estimation circuit is further used for performing the PER estimation on another particular receiving device, and so on. After the PER estimation circuit accomplishes the tests for all the receiving devices, any receiving device(s) incompatible with a threshold PER value can be excluded according to the test results and the receiving device having the packet error rate closest to and smaller than the threshold PER value is selected as the reference receiving device. In this embodiment, the PER estimation circuit records all the receiving devices compatible with the threshold PER value and the reference receiving device into a list table, whereof the list table is stored in a storage unit and the wireless transmission apparatus 100 can determine the broadcasting mechanism according to the list table.

The implementation of the control circuit of the abovementioned SNR/PER estimation circuit can be included in the media access control (MAC) circuit of the wireless transmission apparatus 100. The operation of the control circuit is further illustrated in the following.

Please refer to FIG. 1*a*, FIG. 1*b*, and the related description above. According to an embodiment of the present invention, the operation of the control circuit of the SNR/PER estimation circuit includes the following steps:

Step 1: The recipient quality of the receiving device RX_F is judged as poor according to the SNR/PER estimation results, thus only the receiving devices RX_A, RX_B, RX_C, RX_D, and RX_E are included in the table list capable of stably receiving broadcast data.

Step 2: The recipient quality of the receiving device RX_E is the weakest among the receiving devices that are judged capable of stably receiving broadcast data according to the SNR/PER estimation results, thus the receiving device RX_E is set as the reference receiving device. When the receiving device RX_E receives packet error or packet loss, the ACK signal is not sent to the wireless transmission apparatus 100. When the control circuit found not received the ACK signal corresponding to a particular packet transmitted from the receiving device RX_E, the control circuit will rebroadcast the particular packet. When the wireless transmission apparatus 100 receives the ACK signal transmitted from the receiving device RX_E, the control circuit will presume that there are no packet errors or packet losses that happened in the receiving devices RX_A, RX_B, RX_C, RX_D, and RX_E. At this time, it is not necessary to rebroadcast the packet. That is to say, if the receiving device RX_E with weaker recipient quality can correctly receive the packet, presume that other receiving devices with stronger receiving quality can correctly receive the packet, which meets practical application.

Step 3: A consecutive transmission frequency TX_count of each packet is set, whereof the consecutive transmission frequency TX_count is adjustable. The larger the value, the larger the number of consecutively transmitting packets. Therefore, the packet error ratio of all the receiving devices can be lowered. In this embodiment, whether to or how to adjust the consecutive transmission frequency TX_count can be determined according to the packet error ratio of the reference receiving device RX_E. For example, when the control circuit finds that the number of the ACK signals transmitted by the reference receiving device RX_E within a unit period gets smaller (with respect to the number of the ACK signals that should be transmitted), the control circuit will adjust the consecutive transmission frequency TX_count to be larger.

Step 4: Because even if no packet errors or packet losses happened in the reference receiving device RX_E, packet error or packet loss may have happened in any other of the receiving devices RX_A, RX_B, RX_C, or RX_D. Hence, the control circuit can inquire the receiving devices RX_A, RX_B, RX_C, and RX_D about packets needed to be retrieved according to a predetermined condition T_D, whereof the predetermined condition T_D can be a predetermined cycle or a predetermined packet number.

Step 5: The steps 1 and 2 and/or step 3 are re-executed according to a predetermined condition T_M, thus the table list capable of stably receiving the broadcast data and the reference receiving device can be updated and/or the setting of the consecutive transmission frequency TX_count can be updated, wherein the predetermined condition T_M can be a predetermined period or a predetermined packet amount.

Step 6: Except during the time the wireless transmission apparatus 100 broadcasts data or if the wireless transmission apparatus 100 has sufficient transmission capacity, the wireless transmission apparatus 100 is allowed to perform data communication of traditional WLAN with suitable receiving devices.

In the abovementioned step 3, as for each packet, each of the consecutive transmission frequency counts TX_count can be the same value or a fixed value. Furthermore, the abovementioned steps 3, 4, 5, and 6 can be selectively turned on or off according to the user's setting or a predetermined condition. If the wireless transmission apparatus 100 and the receiving devices can simultaneously work in a plurality of transmission frequency bands (such as 2.4 G/5 G frequency bands) or a plurality of channels of the same frequency band, the wireless transmission apparatus 100 can utilize one frequency band/channel to broadcast packets and another frequency band/channel to re-broadcast packets that need to be re-transmitted, which makes the abovementioned steps more robust.

According to another embodiment of the present invention, the following steps are executed by the control circuit of the SNR/PER estimation circuit on a repeated basis according to a predetermined period:

Step 1: The recipient quality of the receiving device RX_F is judged as poor according to the SNR/PER estimation results, thus only the receiving devices RX_A, RX_B, RX_C, RX_D, and RX_E are included in the table list capable of stably receiving broadcast data.

Step 2: A retransmission priority and/or a retransmission available time of each target receiving device RX_A, RX_B, RX_C, RX_D, and RX_E is determined according to the SNR/PER estimation results. For example, the relationship between each recipient quality of the receiving devices are RX_A>RX_B>RX_C>RX_D>RX_E, thus the retransmission priority is set as RX_E>RX_D>RX_C>RX_B >RX_A and the retransmission available time is set as RX_E≥RX_D≥RX_C≥RX_B ≥RX_A. As mentioned above, the wireless transmission apparatus 100 first responds to the retransmission request from the receiving device RX_E with the weakest recipient quality (the receiving device that was found to most easily have packet error or packet loss). If any one of the receiving devices RX_A, RX_B, RX_C, and RX_D have the same retransmission request for the same packet, the wireless transmission apparatus 100 does not need to respond to the retransmission request of the other receiving devices after responding the retransmission request of the receiving device RX_E and re-broadcasting the packet. In addition, due to the retransmission available time being set as RX_E≥RX_D≥RX_C≥RX_B≥RX_A, the wireless transmission apparatus 100 can utilize more time for responding to the retransmission request of the receiving device RX_E having the weakest recipient quality. Furthermore, the retransmission available time can be flexibly adjusted by the control circuit, or the control circuit can poll whether each receiving device still has non-satisfied transmission request according to the retransmission priority.

Step 3: The wireless transmission apparatus 100 is controlled to continuously broadcast packets within a scheduled period.

Step 4: The packet needing to be retransmitted is retransmitted according to the retransmission priority and the retransmission available time determined in step 2.

Step 5: The wireless transmission apparatus 100 is allowed to perform data communication of traditional WLAN with suitable receiving devices within a scheduled period.

Step 6: Steps 1 to 6 are executed. Step 6 could also be adjusted depending on different design requirement or user's demands, for example, step 6 can be adjusted to every time execute step 1 once, execute steps 2 to 5 twice, and then execute step 6.

Each of the abovementioned steps corresponds to a fixed period or an adjustable period. Furthermore, the scheduled period of Step 3 and Step 5 can be adjusted, whereof Step 5 can be selectively turned on or off depending upon the user's demands or the predetermined condition. If the wireless transmission apparatus 100 and the receiving devices can simultaneously work in a plurality of frequency bands (such as 2.4 G/5 G frequency bands) or a plurality of channels of the same frequency band, the wireless transmission apparatus 100 can utilize one frequency band/channel to broadcast packets and another frequency band/channel to re-broadcast packets needing to be re-transmitted, which makes the abovementioned steps more robust.

Figure 2:
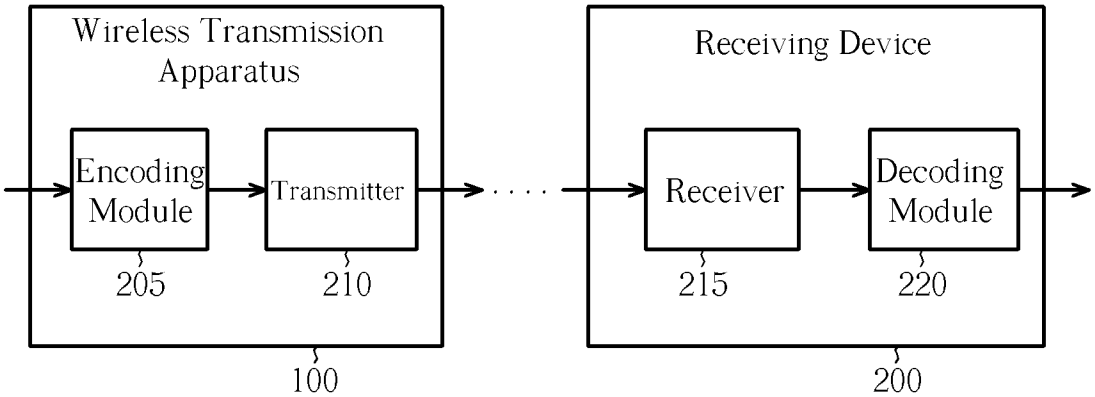
FIG. 2 is a diagram of a wireless transmission apparatus configured with an error correction circuit and a receiving device configured with an error correction circuit according to an embodiment of the present invention.

In addition, in order to reduce packet error or packet loss, the wireless transmission apparatus 100 and various receiving devices in FIG. 1*a* can respectively be configured with an error correction circuit. Please refer to FIG. 2, which is a diagram of a wireless transmission apparatus 100 configured with an error correction circuit and a receiving device configured with an error correction circuit according to an embodiment of the present invention. As shown in FIG. 2, an encoding module 205 of the wireless transmission apparatus 100 encodes received initial data, and a transmitter 210 generates packets according to the encoded initial data and then transmits the packets to the receiving device 200. And then a receiver 215 of the receiving device 200 generates encoded data according to the packets, and a decoding module 220 decodes the encoded data to generate the initial data. Due to the initial data having been encoded before wireless transmission, the encoding module 220 can correct errors of the encoded data according to a decoding algorithm corresponding to the encoded data to generate the initial data even if the wireless transmission process led to an error of the encoded data.

As mentioned above, in this embodiment, the encoding module 205 includes an encoder and an interleaver. The encoder can encode the initial data according to any one of known coding manners, for example, the Reed-Solomon (RS) type error correction code, which includes an RS code, an RS product code or other related formations of the RS code. The interleaver can be a block type interleaver, a convolution type interleaver, or other interleavers of random types, which can scatter and regroup the consecutive output data of the encoder to generate the abovementioned encoded initial data. The decoding module 220 includes a de-interleaver and a decoder corresponding to the encoding module 205, whereof the de-interleaver is used for restoring the data outputted from the receiver 215 to the abovementioned encoded data and the decoder is used for decoding the encoded data to generate the initial data. Due to the implementations of the abovementioned transmitter 210, the receiver 215, the encoder, the interleaver, the de-interleaver, and the decoder being well-known to those skilled in the art, it is not described in detail herein.

In summary, the present invention discloses an effective broadcast mechanism under the premise of limited transmission bandwidth of the wireless transmission apparatus. Not only can the bandwidth restriction generated from the point-to-point transmission mechanism of the wireless local area network be improved, but also can the recipient quality of the receiving device be improved.

Those skilled in the art will readily observe that numerous modifications and alterations of the device and method may be made while retaining the teachings of the invention.

What is claimed is:

1. A wireless transmission apparatus for broadcasting packets to a plurality of receiving devices, the wireless transmission apparatus comprising:

a transmitter for broadcasting first packets to the plurality of receiving devices;

a receiver for receiving signals transmitted from at least one of the receiving devices, the signals including at least a receiving quality component representing the quality at which each of the receiving devices receives the first packets broadcasted by the transmitter; and an estimation circuit, coupled to the receiver, for determining, for each of the receiving devices, whether the receiving device is suitable for receiving additional packets to be broadcast by the transmitter, the estimation circuit determining whether the receiving device is suitable based on the receiving quality component and a signal quality threshold, the estimation circuit further configured to designate each one of the receiving devices that is suitable for receiving the additional packets to be broadcast by the transmitter as a target receiving device, the estimation circuit comprising:

a signal quality estimation circuit for generating a plurality of estimation results based on the signals transmitted from the at least one of the receiving devices, each of the estimation results corresponding to the receiving quality component of each receiving device for receiving the first packets broadcasted by the transmitter;

a control circuit, coupled to the signal quality estimation circuit, for determining whether each of the receiving devices is a target receiving device or not based on the receiving quality component of the corresponding receiving device and the signal quality threshold, wherein based on the control circuit determining that a number of ACK signals transmitted by at least one of the target devices within a unit period changes, the control circuit adjusts a consecutive transmission frequency transmission count to prompt adjustment of a signal quality component corresponding to a packet error ratio; and a storage unit, coupled to the control circuit, for storing identification information of at least one of the target receiving devices;

wherein the transmitter is configured to broadcast the additional packets to the target receiving devices;

wherein the control circuit determines whether at least one of the target receiving devices needs to receive the broadcasted additional packets again according to the identification information and the receiving quality component of the at least one of the target receiving devices; and wherein the transmitter rebroadcasts the additional packets again if needed.

2. The wireless transmission apparatus of claim 1, wherein the control circuit determines a throughput according to a predetermined mechanism or according to settings of a user through a user interface, and determines the signal quality threshold according to the throughput.

3. The wireless transmission apparatus of claim 2, wherein the signal quality threshold is a predetermined signal-to-noise ratio (SNR) threshold and/or a packet error rate (PER) threshold, and the signal quality estimation circuit is a signal-to-noise ratio estimation circuit and/or a packet error rate estimation circuit.

4. The wireless transmission apparatus of claim 3, wherein the signal-to-noise ratio estimation circuit comprises:

a signal intensity detector, coupled to the receiver, for detecting the intensity of the signals transmitted from the receiving devices to generate a plurality of detection results, each of the detection results corresponds to the intensity of the signals transmitted from each of the receiving devices; and a mapping table, coupled to the signal intensity detector and to the control circuit, for generating the estimation results according to the detection results.

5. The wireless transmission apparatus of claim 3, wherein the transmitter transmits training packets of a plurality of particular formats to one of the receiving devices and the receiving device transmits an acknowledge signal to the receiver on receipt of the training packets of each particular format, and the packet error rate estimation circuit comprises:

a counter, coupled to the receiver and the control circuit, for generating one of the estimation results according to the acknowledge signal/signals.

6. The wireless transmission apparatus of claim 5, wherein the particular formats include at least two of binary phase-shift keying (BPSK), quadrature phase-shift keying (QPSK), 16 quadrature amplitude modulation (16 QAM), 64 quadrature amplitude modulation (64 QAM), 128 quadrature amplitude modulation (128 QAM), and 256 quadrature amplitude modulation (256 QAM).

7. The wireless transmission apparatus of claim 1, wherein the control circuit determines whether each of the receiving devices is the target receiving device and stores suitability information of the target receiving devices by judging whether the estimation results satisfy the signal quality threshold.

8. The wireless transmission apparatus of claim 7, wherein the control circuit determines whether any one of the target devices needs to receive the broadcasted packet again according to the suitability information and the receiving quality component of the target receiving devices, and wherein the transmitter rebroadcasts the additional packets again if needed.

9. The wireless transmission apparatus of claim 7, wherein the control circuit selects a reference receiving device from the target receiving devices and stores the identification information of the reference receiving device according to differences between each of the estimation results and the signal quality threshold, wherein the control circuit determines whether the reference receiving device needs to receive the broadcasted additional packets again according to the identification information and the receiving quality component of the reference receiving device, and wherein the transmitter rebroadcasts the broadcasted additional packets again if needed.

10. The wireless transmission apparatus of claim 9, wherein the control circuit determines whether the reference receiving device needs to receive the broadcasted additional packets again when a first condition is satisfied, and determines whether the reference receiving device and/or other target receiving devices need to receive the broadcasted additional packets again when a second condition is satisfied.

11. The wireless transmission apparatus of claim 10, wherein a time period that satisfies the first condition is smaller than a time period that satisfies the second condition.

12. The wireless transmission apparatus of claim 9, wherein the control circuit determines a consecutive transmission frequency of each packet broadcasted by the transmitter according to a packet error rate of the reference receiving device.

13. The wireless transmission apparatus of claim 7, wherein the control circuit determines a retransmission priority and/or a retransmission available time of each target receiving device according to the differences between each of the estimation results and the signal quality threshold, and wherein the transmitter rebroadcasts the additional packets according to the retransmission priority and/or the retransmission available time.

14. The wireless transmission apparatus of claim 1, wherein the control circuit selects a reference receiving device from the target receiving devices and stores the identification information of the reference receiving device according to differences between each of the estimation results and the signal quality threshold, wherein the control circuit determines whether the reference receiving device needs to receive the additional packets again according to the identification information and the receiving quality component of the reference receiving device, and wherein the transmitter rebroadcasts the additional packets again if needed.

15. The wireless transmission apparatus of claim 14, wherein the control circuit determines a consecutive transmission frequency of each packet broadcasted by the transmitter according to a packet error rate of the reference receiving device.

16. The wireless transmission apparatus of claim 1 further comprising:

an encoder for encoding initial data to generate encoded data; and an interleaver, coupled to the encoder and to the transmitter, for interleaving the encoded data to generate encoded initial data, the transmitter configured to broadcast packets according to the encoded initial data.

17. The wireless transmission apparatus of claim 1, wherein the transmitter utilizes a first frequency band to broadcast the additional packets and utilizes a second frequency band to rebroadcast the broadcasted additional packets, and at least one of the target receiving devices utilizes the first frequency band to receive the additional packets of the first frequency band and utilizes the second frequency band to receive the re-broadcasted additional packets.

18. The wireless transmission apparatus of claim 1, wherein the transmitter utilizes a first channel to broadcast the additional packets and utilizes a second channel to rebroadcast the broadcasted additional packets, and at least one of the target receiving devices utilizes the first channel to receive the additional packets of the first channel and utilizes the second channel to receive the re-broadcasted additional packets.

19. The wireless transmission apparatus of claim 1, wherein the control circuit permits the transmitter to communicate data with any one of the receiving devices within a scheduled period according to a predetermined time.

20. The wireless transmission apparatus of claim 1, wherein the wireless transmission device is a wireless local area network (WLAN) access point, a personal computer (PC), a personal digital assistant (PDA), a mobile device, or a TV set-top box.

21. A wireless transmission method for broadcasting packets to a plurality of receiving devices, the wireless transmission method comprising:

broadcasting a plurality of first packets to the plurality of receiving devices;

receiving signals transmitted from at least one of the receiving devices to generate a plurality of estimation results, the signals including at least a receiving quality component representing the quality at which each of the receiving devices receives the broadcasted first packets;

determining whether each of the receiving devices is suitable for receiving additional broadcasted packets based on the receiving quality component and a signal quality threshold and designating each one of the receiving devices that is suitable for receiving the additional packets to be broadcasted as a target receiving device;

generating a plurality of estimation results based on the signals transmitted from the at least one of the receiving devices, each of the estimation results corresponding to the receiving quality component of each receiving device for receiving the broadcasted first packets;

determining whether each of the receiving devices is a target receiving device or not based on the receiving quality component of the corresponding receiving device and the signal quality threshold, wherein based on determining that a number of ACK signals transmitted by at least one of the target devices within a unit period changes, adjustinq a consecutive transmission frequency transmission count to prompt adjustment of a signal quality component corresponding to a packet error ratio;

storing identification information of at least one of the target receiving devices, the at least one of the target receiving devices configured to receive the additional packets to be broadcasted; and determining whether the at least one of the target receiving devices needs to receive the broadcasted additional packets again according to the identification information and the receiving quality component of the at least one of the target receiving devices, wherein the additional packets are rebroadcast again if needed.

22. The wireless transmission method of claim 21, wherein the signal quality threshold is a predetermined signal-to-noise ratio (SNR) threshold and/or a packet error rate (PER) threshold.

23. The wireless transmission method of claim 22, wherein the step of generating the estimation results comprises a signal-to-noise ratio estimating step, comprising:

detecting the intensity of the signals transmitted from the receiving devices to generate a plurality of detection results, each of the detection results corresponding to the intensity of the signals transmitted from each of the receiving devices; and generating the estimation results according to the detection results.

24. The wireless transmission method of claim 22, wherein the step of generating the estimation results comprises a packet error rate estimating step, comprising:

transmitting training packets of a plurality of particular formats to any one of the receiving devices, and the receiving device transmitting an acknowledge signal on receipt of the training packets of each particular format;

receiving the acknowledge signals; and counting the acknowledge signals to generate one of the estimation results.

25. The wireless transmission method of claim 21, wherein the step of determining whether at least one of the target receiving devices needs to receive the broadcasted packet comprises:

selecting a reference receiving device from the target receiving devices and storing identification information of the reference receiving device according to differences between each of the estimation results and the signal quality threshold; and determining whether the reference receiving device needs to receive the broadcasted additional packet again according to the identification information and the signals transmitted from the reference receiving device and re-broadcasting the broadcasted additional packet again if needed.

26. The wireless transmission method of claim 25, further comprising: determining a consecutive transmission frequency of each of the packets according to a packet error rate of the reference receiving device.

27. The wireless transmission method of claim 21, wherein the step of broadcasting the packets to the receiving devices comprises:

encoding initial data to generate encoded data;

interleaving the encoded data to generate encoded initial data;

generating the packets according to the encoded initial data; and broadcasting the packets.

28. The wireless transmission method of claim 21, wherein the step of broadcasting the packets to the receiving devices comprises:

utilizing a first frequency band to broadcast the packets and utilizing a second frequency band to rebroadcast the broadcasted packets; and at least one of the target receiving devices utilizing the first frequency band to receive the packets and utilizing the second frequency band to receive the re-broadcasted packets.

29. The wireless transmission method of claim 21, wherein the step of broadcasting the packets to the receiving devices comprises:

utilizing a first channel to broadcast the packets and utilizing a second channel to rebroadcast the broadcasted packets; and at least one of the target receiving devices utilizing the first channel to receive the packets and utilizing the second channel to receive the re-broadcasted packets.

30. A wireless transmission apparatus comprising:

a transmitter configured to broadcast first packets to a plurality of receiving devices;

a receiver configured to receive a signal from each of the receiving devices, each signal including at least a reception quality value representing the quality at which the respective receiving device is able to receive the first packets; and an estimation circuit, coupled to the receiver and configured to determine whether each receiving device is suitable to receive additional packets to be broadcast by the transmitter, the estimation circuit configured to determine whether each receiving device is suitable based on the receiving quality component and a signal quality threshold, the estimation circuit further configured to designate each one of the receiving devices that is suitable for receiving the additional packets to be broadcast by the transmitter as a target receiving device, the estimation circuit configured to determine that receiving devices not suitable to receive additional packets are defined as excluded receiving devices, wherein the estimation circuit comprises:

a signal quality estimation circuit for generating a plurality of estimation results based on the signals transmitted from the at least one of the receiving devices, each of the estimation results corresponding to the receiving quality component of each receiving device for receiving the first packets broadcasted by the transmitter;

a control circuit, coupled to the signal quality estimation circuit, for determining whether each of the receiving devices is a target receiving device or not based on the receiving quality component of the corresponding receiving device and the signal quality threshold, wherein based on the control circuit determining that a number of ACK signals transmitted by at least one of the target devices within a unit period changes, the control circuit adjusts a consecutive transmission frequency transmission count to prompt adjustment of a signal quality component corresponding to a packet error ratio; and a storage unit, coupled to the control circuit, for storing identification information of at least one of the target receiving devices;

wherein the transmitter is further configured to broadcast the additional packets to the target receiving devices; and wherein the receiver is configured to receive a re-broadcast request from one of the target receiving devices and is further configured to ignore re-broadcast requests from the excluded receiving devices.

31. The wireless transmission apparatus of claim 30, wherein the transmitter is further configured to re-broadcast the additional packets in response to a re-broadcast request from one of the target receiving devices.

32. The wireless transmission apparatus of claim 31, wherein the estimation circuit is configured to select the target receiving device having the poorest reception quality value as a reference receiving device, and wherein the estimation circuit responds to re-broadcast requests from the reference receiving device.

33. The wireless transmission apparatus of claim 30, wherein the estimation circuit determines whether the receiving devices are suitable to receive additional packets from the transmitter by comparing the reception quality values with a predetermined threshold.

34. The wireless transmission method of claim 33, wherein the predetermined threshold is one of a predetermined signal-to-noise ratio (SNR) threshold and a packet error rate (PER) threshold.

35. The wireless transmission method of claim 34, wherein the estimation circuit comprises at least one of a signal-to-noise ratio (SNR) estimation circuit and a packet error rate (PER) estimation circuit, the SNR estimation circuit configured to detect the intensity of the signal from each of the receiving devices transmitted from the receiving devices, and the PER estimation circuit configured to determine a consecutive transmission frequency of each packet broadcast by the transmitter.

36. The wireless transmission method of claim 30, wherein the transmitter is configured to broadcast the additional packets over a first frequency band and is configured to re-broadcast the additional packets over a second frequency band.

* * * * *